US008371363B2

(12) United States Patent
Kaemmerer et al.

(10) Patent No.: US 8,371,363 B2
(45) Date of Patent: Feb. 12, 2013

(54) APPARATUS FOR DIE CASTING, THE USE OF SUCH AN APPARATUS AND METHOD FOR DIE CASTING

(75) Inventors: Marco Kaemmerer, Soemmerda (DE); Matthias Huke, Soemmerda (DE)

(73) Assignee: KSM Castings Group GmbH, Hildesheim (DE)

( * ) Notice: Subject to any disclaimer, the term of this patent is extended or adjusted under 35 U.S.C. 154(b) by 0 days.

(21) Appl. No.: 12/998,502

(22) PCT Filed: Oct. 6, 2009

(86) PCT No.: PCT/DE2009/001385

§ 371 (c)(1), (2), (4) Date: Apr. 27, 2011

(87) PCT Pub. No.: WO2010/048916

PCT Pub. Date: May 6, 2010

(65) Prior Publication Data

US 2011/0203763 A1 Aug. 25, 2011

(30) Foreign Application Priority Data

Oct. 28, 2008 (DE) ..... 10 2008 053 435

(51) Int. Cl.
*B22D 33/04* (2006.01)

(52) U.S. Cl. ..... 164/137; 164/113; 164/340; 164/341

(58) Field of Classification Search ..... 164/340, 164/341, 137, 113
See application file for complete search history.

(56) References Cited

U.S. PATENT DOCUMENTS

| | | | | |
|---|---|---|---|---|
| 3,343,801 | A | 9/1967 | Münzer et al. | |
| 4,721,280 | A | 1/1988 | Barainsky | |
| 6,799,625 | B2 * | 10/2004 | Eliat | 164/340 |
| 7,275,583 | B2 * | 10/2007 | Eisen | 164/312 |
| 7,685,985 | B2 | 3/2010 | Madeira | |

FOREIGN PATENT DOCUMENTS

| | | |
|---|---|---|
| DE | 25 48 254 | 5/1799 |
| DE | 743 247 | 12/1943 |
| DE | 1 073 157 | 1/1960 |
| DE | 11 14 027 | 9/1961 |
| DE | 1 479 189 | 4/1969 |
| DE | 33 35 036 | 4/1985 |
| DE | 34 14 231 | 10/1985 |
| DE | 40 26 986 | 4/1991 |
| DE | 41 02 358 | 7/1992 |
| DE | 43 07 313 | 9/1994 |
| DE | 44 03 219 | 8/1995 |
| DE | 197 46 102 | 4/1999 |
| EP | 1 878 906 | 1/2008 |
| GB | 1 575 136 | 9/1980 |
| GB | 2 236 556 | 4/1991 |
| JP | 2002-018904 | 1/2002 |

OTHER PUBLICATIONS

International Search Report , PCT/DE2009/001385, Oct. 6, 2009.
Dipl.-Ing. Ernst Brunhuber, Praxis der Druckgβfertigung, Fachverlag Schiele ( Schön GmbH, Berlin, Aug. 18, 1981, pp. 164-175, 182-183.

* cited by examiner

*Primary Examiner* — Kuang Lin
(74) *Attorney, Agent, or Firm* — Collard & Roe, P.C.

(57) ABSTRACT

The invention relates to an apparatus for producing a die cast part having arc-shaped inside and/or outside contours.

28 Claims, 1 Drawing Sheet

APPARATUS FOR DIE CASTING, THE USE OF SUCH AN APPARATUS AND METHOD FOR DIE CASTING

CROSS REFERENCE TO RELATED APPLICATIONS

This application is the National Stage of PCT/DE2009/001385 filed on Oct. 6, 2009, which claims priority under 35 U.S.C. §119 of German Application No. 10 2008 053 435.8 filed on Oct. 28, 2008, the disclosure of which is incorporated by reference. The international application under PCT article 21(2) was not published in English.

BACKGROUND OF THE INVENTION

1. Field of the Invention

The invention relates to an apparatus for die casting, the use of such an apparatus and a method for die casting.

Die casting is nowadays a widespread and successfully used industrial production process for the primary shaping of parts and products in large numbers. The main feature of this process is that a metal melt in die casting machines is pressed under high pressure at a high speed into a multi-part, usually two-part permanent mould, which is also referred to as a casting tool or moulding tool, from which the die cast part is ejected after having solidified.

The machines for performing the die casting process are usually fully automated nowadays and enable very efficient production of dimensionally accurate die cast parts with high demands on a smooth, clean surface. Die casting machines basically have the task of accommodating the permanent mould, closing, filling and opening the latter and ejecting the die cast part. In the employed permanent moulds, which on account of the occurring mechanical and thermal loads are usually made from heat-resisting materials, preferably from high-strength hot-work steels, metals can be processed at a sufficiently low melting temperature, in particular the metals copper, aluminium, magnesium, zinc, tin, lead and similar metals as well as alloys of these metals.

In connection with this invention, die casting is understood to mean all processes in which at least fluid, pulpy or pasty casting metal is poured into a permanent mould under raised pressure. This includes die casting, squeeze casting, thixocasting, thixomoulding or comparable processes.

The cavity of the permanent mould reproduces the three-dimensional geometry of the die cast part to be cast. The permanent mould is designed so that the solidified die cast part can be removed from the permanent mould without difficulty. For this reason, the permanent mould usually comprises a fixed mould half and a mobile mould half. The two mould halves of the permanent mould are closed in the state ready for casting, i.e. in the casting position. They are kept closed by the closing force or locking force of the die casting machine during the casting process.

When the mould halves are parted, the parting plane is usually positioned in such a way that, during the opening of the permanent mould, the die cast part remains in the mobile mould half and in the opening position can be ejected from the permanent mould.

The two mould halves thus usually define the main mould parting line and usually also form the greater part of the contour of the die cast part to be cast.

Often, however, it is necessary to incorporate so-called fixed cores into the mould halves, said cores chiefly serving to form holes, blind holes, openings or recesses in the die cast part. They must under no circumstances hinder the opening of the permanent mould or the ejection of the die cast part.

Mobile cores and/or contour parts are required for the formation of cavities in the die cast part, for example holes, recesses, openings or blind holes which do not run in the mould-closing direction. Said mobile cores and/or contour parts are designed such that they form the corresponding contour in the die cast part.

These cores are introduced into the permanent mould before the casting and are released again after the casting, i.e. pulled out of the die cast part. Hydraulically or mechanically operated core-pull devices, which are also referred to as core pullers, are normally used for this purpose.

Since mobile cores are shape-forming parts of the permanent mould and come into contact with the liquid metal, they are usually also produced from heat-resisting material.

The mobile cores are usually locked by the two mould halves in an inserted casting position. If locking by means of the mould halves is not possible for design reasons, however, it is necessary when using a hydraulic core-pulling cylinder for the piston force of the latter to be greater than the core explosive force exerted by the casting pressure on the projection area of the core.

When use is made of a hydraulic core-pulling cylinder, the latter is usually also dimensioned in such a way that its tractive force is greater than the shrinkage of the die cast part around the mobile core.

2. The Prior Art

Die cast parts with curved or bent or arc-shaped cavities, i.e. for example with curved channels, openings, holes, recesses or blind holes, cannot be completely produced by means of mobile cores according to the prior art.

For the production of a die cast part, DE 41 02 358 C2 proposes inserting a hollow body filled with a core medium and with a predetermined curvature into the permanent mould. After the die casting, the core medium is removed. The curved hollow body remains in the die cast part and thus forms the desired curved functional cavity. The process is expensive.

Proceeding from the prior art, the problem underlying the invention is to find an alternative solution for producing a die, cast part with an arc-shaped or curved inside and/or outside casting contour.

According to the invention, this problem is solved by an apparatus for producing a die cast part with an arc-shaped or curved or arched outside and/or inside casting contour according to the features of claim 1. Developments and advantageous embodiments emerge from the sub-claims.

The apparatus according to the invention for producing a die cast part with an arc-shaped, curved or arched inside and/or outside casting contour comprises a permanent mould with at least one mobile arc-shaped slide-valve core, which forms the inside and/or outside casting contour of the die cast part, wherein a rotary slide-valve arrangement is provided which moves the slide-valve core before the die casting on an arc-shaped path into the permanent mould and after die casting onto an arc-shaped path out of the permanent mould.

It is thus possible for the first time to produce, with a completely accurate contour, a die cast part with an arc-shaped or curved or arched inside and/or outside contour.

The slide-valve core is moved here about an imaginary centre-point on the arc-shaped path.

A development of the invention makes provision such that the rotary slide-valve arrangement is a mechanical, pneumatic or preferably a hydraulically operated core push-and-pull device.

Furthermore, provision is made such that the rotary slide-valve arrangement comprises an arc-shaped rotary slide valve, preferably in the manner of an annular or flat-ring segment, wherein the rotary slide valve is connected to the slide-valve core at the end face and preferably in a firmly bonded manner.

An advantageous embodiment of the invention makes provision such that the rotary slide-valve arrangement comprises one or more, preferably different, means which is or are in an active connection with the rotary slide valve, in such a way that said means imparts or impart preferably a likewise arc-shaped displacement movement and preferably position-fixing to the rotary slide valve and thus to the slide-valve core.

Provision is expediently made such that the means comprise one or preferably two hydraulic cylinders with a piston rod, wherein the piston rod is in an active connection with the rotary slide valve, in such a way that, when a rectilinear displacement of the piston rod takes place, an arc-shaped displacement movement is imparted to the rotary slide valve and thus on the slide-valve core.

It is advantageous here that the rotary slide-valve arrangement according to the invention does not require a central bearing in order to guide the rotary slide valve on an arc-shaped path. The space for such a central bearing is not available for the production of die cast parts in most cases of application, since this space is required for shape-forming parts, for example of a moulding half of the permanent mould.

Provision is advantageously made such that the rotary slide-valve arrangement comprises a preferably stationary rotary slide-valve guide, which is constituted in such a way that the rotary slide valve, when the latter is pushed or pulled at the end face not connected to the slide-valve core, is moved in an arc-shaped manner in the slide-valve guide.

A further development of the invention makes provision such that the slide-valve guide is constituted as an arc-shaped bush with a cross-section matched to the rotary slide valve, in which bush the arc-shaped rotary slide valve can move.

The hydraulic cylinder with the piston rod is expediently disposed in such a way that, when the rotary slide valve is displaced in the direction of the permanent mould, force is essentially exerted only on the inner face of the arc-shaped rotary slide-valve guide that forms the outer radius and such that, when the rotary slide valve is displaced in the direction of the mould-removal position, i.e. when the rotary slide valve is pulled out, force is essentially exerted only on the inner face of the arc-shaped rotary slide-valve guide that forms the inner radius.

The expenditure of force for the displacement of the rotary slide valve together with the slide-valve core inside the rotary slide-valve guide is thus relatively small and distributes itself, so that the susceptibility to wear can be kept extremely low and the useful life of the rotary slide-valve arrangement is increased.

Furthermore, provision is made such that means are provided for introducing and distributing lubricant, in particular oil or grease, between the rotary slide-valve guide and the rotary slide valve.

According to an advantageous embodiment of the invention, the means comprise at least one distributor groove, which is preferably drawn over the length of the outer radius of the rotary slide-valve guide present on the inner face and is countersunk therein, wherein the distributor groove is connected to at least one supply channel which leads into the rotary slide-valve guide.

Tightness of the rotary slide valve or seizing-up of the rotary slide valve in the rotary slide-valve guide is thus prevented and the durability of these parts is increased.

A further development of the invention makes provision such that the means comprise lubricating grooves which are disposed on the rotary slide valve, wherein the lubricating grooves preferably run in a radiating manner towards the imaginary centre-point of the arc-shaped rotary slide valve. Tightness of the rotary slide valve or seizing-up of the rotary slide valve in the rotary slide-valve guide is thus also prevented and the durability of these parts is increased.

The rotary slide-valve arrangement expediently comprises means which locks or lock the rotary slide valve and therefore the slide-valve core after the movement into the open or closed permanent mould and before the movement out of the open or closed permanent mould and preferably simultaneously apply the main mould-removal force.

A combination slide valve is preferably provided, which is constituted in such a way that, on the one hand, it locks the rotary slide valve together with the slide-valve core after the movement into the permanent mould and moves the rotary slide valve together with the slide-valve core into the final casting position, and that, on the other hand, it unlocks the rotary slide valve together with the slide-valve core before the movement out of the permanent mould, thereby releases the slide-valve core from the die cast part and moves the rotary slide valve together with the slide-valve core into a preliminary mould-removal position.

The combination slide valve makes it possible to dimension the hydraulic cylinder of the rotary slide-valve arrangement relatively small, since the hydraulic cylinder of the rotary slide-valve arrangement is required only for the relatively small force-expending displacement of the rotary slide valve out of the initial position into a preliminary final casting position and out of the preliminary mould-removal position into a mould-removal position, which at the same time is again the initial position. The hydraulic cylinder of the rotary slide-valve arrangement does not therefore have to be constituted in such a way that its piston force is greater than the so-called core explosive force exerted by the casting pressure on the projection area of the slide-valve core. The hydraulic cylinder of the rotary slide-valve arrangement likewise does not have to be constituted so large that the tractive force acting on the rotary slide valve and therefore on the slide-valve core is greater than the shrinkage force of the die cast part around the mobile arc-shaped core.

The combination slide valve can advantageously be operated mechanically, pneumatically or preferably hydraulically, wherein a hydraulic cylinder is preferably provided, the piston rod whereof is in an active connection with the combination slide valve.

The rotary slide valve and the rotary slide-valve guide preferably each comprise a recess, which are constituted in such a way that, after the slide-valve core has been moved into the permanent mould, they form a common opening for accommodating the combination slide valve, wherein the combination slide valve and the opening are constituted in such a way that the rotary slide valve together with the slide-valve core is locked when the combination slide valve is pushed into this opening, wherein the rotary slide valve together with the slide-valve core is moved into the final casting position, and that the rotary slide valve together with the slide-valve core is unlocked when the combination slide valve is pulled out of this opening, wherein the slide-valve core is released from the die cast part and the rotary slide valve together with the slide-valve core is moved into a preliminary mould-removal position.

A development of the invention makes provision such that the combination slide valve and the recess of the rotary slide valve comprise inclined planes, in such a way that, when the combination slide valve is pushed into the recess of the rotary slide valve, the rotary slide valve is displaced in the direction of the permanent mould and such that, when the combination slide valve is pulled out of the recess of the rotary slide valve, the rotary slide valve is displaced in the opposite direction to the permanent mould, i.e. in the mould-removal direction.

It has been shown that it is thus possible, with relatively little expenditure of force, to exert a force on the rotary slide valve that is greater than the core explosive force exerted by the casting pressure on the projection area of the slide-valve core and that the combination slide valve can be moved out of the opening likewise with relatively little expenditure of force, wherein the tractive force acting here on the rotary slide valve and therefore on the slide-valve core is greater than the shrinkage force of the die cast part around the mobile arc-shaped core.

The combination slide valve and the opening are advantageously constituted with a precise fit with respect to one another. The contact faces seal the recess of the rotary slide-valve guide in the final casting position.

An advantageous embodiment of the invention makes provision such that the end face of the slide-valve core not connected to the rotary slide valve is connected after the locking, preferably by contact pressure, to a shape-forming part of the permanent mould, in such a way that the connection is tight with respect to a casting material flowing under pressure.

Furthermore, provision is made such that the casting material is a casting metal and preferably comprises aluminium, magnesium, zinc or alloys with one or more of these metals.

Furthermore, provision is made such that the rotary slide valve comprises edges running conically towards one another at its end face pointing towards the permanent mould, and the permanent mould, which comprises a corresponding recess for the rotary slide valve, comprises contact faces correspondingly running towards one another. Such an embodiment protects against damage to the tool as a result of fretting corrosion. Back-casting of the surfaces due to the molten casting material is prevented. So-called tinsel formation is also reduced.

Tinsel is understood here to mean generally solidified casting metal, usually in the form of thin burrs.

Means are preferably provided which, after the unlocking of the rotary slide valve together with the slide-valve core, blow sealing air into the gap between the rotary slide valve and the permanent mould in the direction of the slide-valve core. This sealing air blows away any tinsel that may be present.

It has been shown that such sealing air also contributes sufficiently to the cooling of the slide-valve core and the rotary slide valve, so that no temperature-regulating channels are required inside the rotary slide valve or the slide-valve core.

The rotary slide valve and the slide-valve core are preferably made from heat-resisting materials, in particular from hot-work steel, the surface of the slide-valve core preferably being nitration-hardened.

Furthermore, the invention relates to the use of an apparatus as described herein for producing die cast parts for the automotive industry, in particular a housing of an internal combustion engine with bent intake manifolds integrally molded in one piece.

Moreover, the invention relates to a method for producing a die cast part with an arc-shaped inside and/or outside casting contour, in particular using an apparatus as described herein, wherein an arc-shaped slide-valve core is moved into a permanent mould before the die casting and out of the permanent mould after the die casting on an arc-shaped path, which is essentially defined by the radius of the slide-valve core.

An advantageous embodiment of the invention makes provision here such that the slide-valve core is moved by means of a rotary slide valve, wherein the rotary slide valve together with the slide-valve core is moved before the die casting by means of a first actuation device into a preliminary final casting position, that a second actuation device then moves and thereby locks the rotary slide valve together with the slide-valve core before the die casting into a final casting position, that after the die casting said second actuation device moves the rotary slide valve together with the slide-valve core into a preliminary mould-removal position, wherein the slide-valve core is released from the solidified die cast part and the rotary slide valve together with the slide-valve core is unlocked, and that finally the rotary slide valve together with the slide-valve core is moved by means of said first actuation device into a mould-removal position, which at the same time is the initial position.

BRIEF DESCRIPTION OF THE DRAWINGS

The invention is explained below in greater detail with the aid of an example of embodiment represented schematically in the drawing. In the figures.

DETAILED DESCRIPTION OF THE PREFERRED EMBODIMENTS

Figure 1:
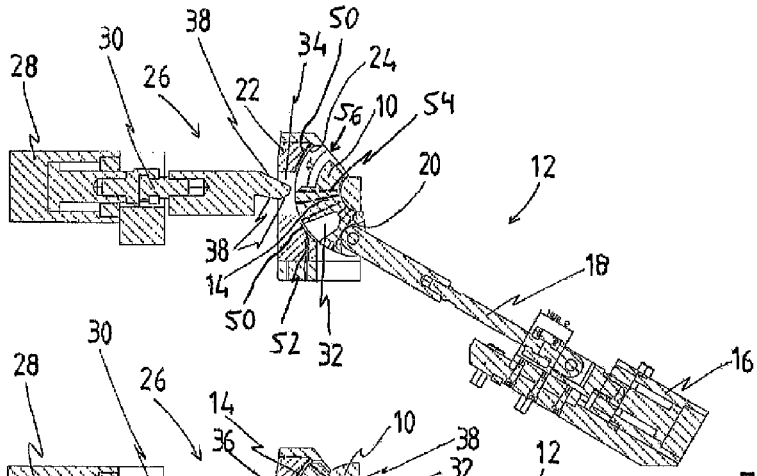
FIG. 1 shows, in cross-section, the inventive rotary slide-valve arrangement together with a combination slide valve in the mould-removal or initial position.

Inventive rotary slide-valve arrangement 12 together with combination slide valve 26 shown in cross-section in the drawing is a component part of a permanent mould or a die casting machine not represented further here. The features essential for an understanding of the invention are represented and explained in the drawing. Identical reference numbers used in the figures also denote in each case identical parts.

A permanent mould or casting mould with a rotary slide-valve arrangement 12 according to the invention and a combination slide valve 26 can be used for example for producing a housing of an internal combustion engine with bent or curved intake manifolds integrally moulded in one piece. Such an intake manifold was previously produced either by various parts, which have been connected to one another and to the housing of the internal combustion engine at a high cost, or by cast contours which could be mechanically finished at a high cost. Such a prior art is known for example from EP 1 878 906 A2.

The apparatus according to the invention for producing a die cast part with an arc-shaped inside and/or outside casting contour, for example precisely such a housing of an internal combustion engine with curved intake manifolds, comprises a permanent mould not represented here, which comprises a fixed mould half and a mobile mould half, and at least one mobile arc-shaped slide-valve core 10 according to the invention, which forms the inside and/or outside casting contour of the die cast part, i.e. for example of the previously mentioned intake manifold, wherein an inventive rotary slide-valve arrangement 12 is provided, which moves slide-valve core 10 before the die casting, i.e. before the start of the actual casting process, on an arc-shaped path into the permanent mould and after die casting, i.e. after the solidification of the die cast part, on an arc-shaped path out of the permanent mould.

The arc-shaped path is defined here by a predetermined path section on the radius defined by the geometry or curvature of slide-valve core 10.

Rotary slide-valve arrangement 12 is a hydraulically operated core push-and-pull arrangement. It comprises an arc-shaped rotary slide valve 14 in the manner of a flat-ring segment. Rotary slide valve 14 is connected in a firmly bonded manner on one end face 42 to slide-valve core 12, wherein in the present case end face 42 of rotary slide valve 14 is dimensioned greater than the end face of slide-valve core 12 connected to it in a firmly bonded manner, so that the as yet free end face 42 of rotary slide valve 14 then acts as a shape-forming part inside the permanent mould and is connected tightly to the latter, preferably by contact pressure.

Figure 3:
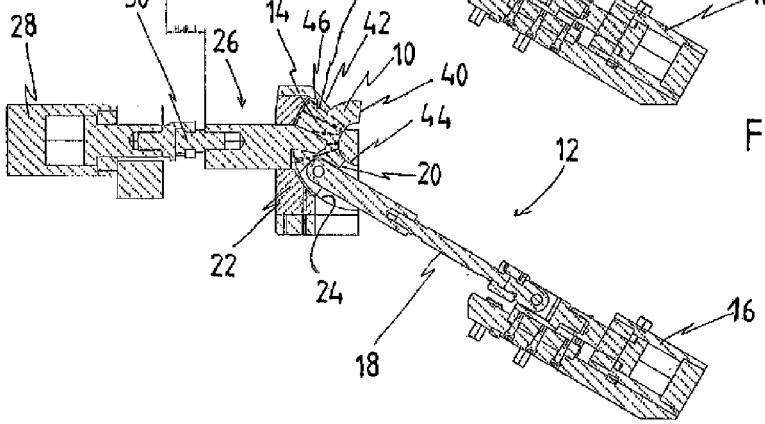
FIG. 3 shows, in cross-section, the inventive rotary slide-valve arrangement together with a combination slide valve in the final casting position.

As shown in FIG. 3, the rotary slide valve 14 includes edges 46 running concentrically towards one another at its end face 42 pointing towards the permanent mold, and the permanent mold, which includes a corresponding recess 56 shown in FIG. 1 for the rotary slide vlave 14, includes contact faces 48 correspondingly running towards one another.

Rotary slide-valve arrangement 12 comprises a hydraulic cylinder 16, piston rod 18 whereof is in an active connection with end face 20 of rotary slide valve 14 that is not connected to slide-valve core 10, and in such a way that, with a rectilinear displacement of piston rod 18, an arc-shaped displacement movement is imparted to rotary slide valve 14 and therefore to slide-valve core 10. For this purpose, a preferably stationary rotary slide-valve guide 22 is additionally provided, which is constituted in such a way that rotary slide valve 14, when the latter is pushed or pulled at end face 20 not connected to slide-valve core 10, is moved in an arc-shaped manner in slide-valve guide 22. Slide-valve guide 22 is constituted here as an arc-shaped bush, in which arc-shaped rotary slide valve 14 can be moved, wherein the bush comprises an inner cross-section matched to rotary slide valve 14.

A particular advantage of the invention emerges at this point. As can clearly be seen in the figures, rotary slide-valve arrangement 12 according to the invention does not require a central bearing in order to guide rotary slide valve 14 on an arc-shaped path. The space for such a central bearing is not available in most cases of application, especially for the production of a housing of an internal combustion engine with curved intake manifolds, since this space is required for shape-forming parts, for example of a mould half of the permanent mould.

A further advantage of the invention can also clearly be seen from the drawing. That is to say that hydraulic cylinder 16 with piston rod 18 is disposed in such a way that the expenditure of force for displacing rotary slide valve 14 together with slide-valve core 10 inside rotary slide-valve guide 22 is relatively small and distributes itself, so that the susceptibility to wear can be kept extremely low. When rotary slide valve 14 is displaced in the direction of the permanent mould, i.e. in the direction of the casting position, force is essentially exerted only on the inner face of arc-shaped rotary slide-valve guide 22 that forms outer radius 24. When rotary slide valve 14 is displaced in the direction of the mould-removal position, i.e. when rotary slide valve 14 is pulled out, force is essentially exerted only on the inner face of arc-shaped rotary slide-valve guide 22 that forms inner radius 44.

As shown in FIG. 1, means are provided for introducing and/or distributing lubricant, in particular oil or grease, between the rotary slide-valve guide 22 and the rotary slide valve 14 during the production process. The means may include at least one distributor groove 50, which is preferably drawn over the length of the outer radius 24 of the rotary slide-valve guide 22 that lies on the inner face and is countersunk therein. The distributor groove 50 is connected to at least one supply channel 52 which leads from the exterior into the rotary slide-valve guide 22. The means may include lubricating grooves 54 which are disposed on the rotary slide valve 14. The lubricating grooves 52 preferably run in a radiating manner towards the imaginary center-point of the arc-shaped rotary slide valve 14.

Figure 2:
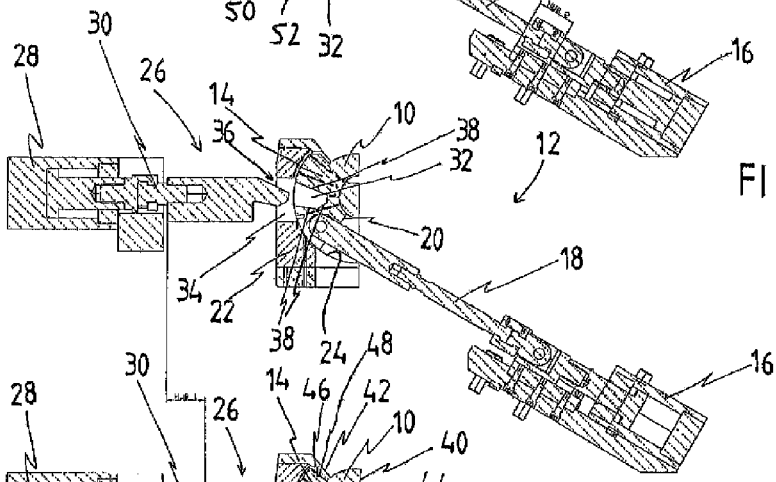
FIG. 2 shows, in cross-section, the inventive rotary slide-valve arrangement together with a combination slide valve in the preliminary mould-removal or preliminary final casting position

Furthermore, the apparatus according to the invention comprises a combination slide valve 26, which is constituted such that, on the one hand, it locks rotary slide valve 14 together with slide-valve core 10 after the movement into the permanent mould and moves rotary slide valve 14 together with slide-valve core 10 into the final casting position, as is represented in FIG. 3, and that, on the other hand, it first unlocks rotary slide valve 14 together with slide-valve core 10 before the complete pulling-out from the permanent mould, thereby releases slide-valve core 10 from the solidified die cast part and moves rotary slide valve 14 together with slide-valve core into a preliminary mould-removal position, as is represented in FIG. 2.

Combination slide valve 26 is, so to speak, a locking and unlocking slide valve as well as a preliminary mould-removal slide valve at one and the same time.

Such a combination slide valve 26 makes it possible to dimension hydraulic cylinder 16 of rotary slide-valve arrangement 12 relatively small, because the latter 16 only moves, i.e. pushes and pulls, rotary slide valve 14 together with slide-valve core 10 without great expenditure of force.

The actual force is applied by hydraulically operated combination slide valve 26. Here too, however, employed hydraulic cylinder 28 with piston rod 30, which is in an active connection with combination slide valve 26, can be dimensioned relatively small.

Combination slide valve 26 and opening 36 are constituted here in such a way that rotary slide valve 14 together with slide-valve core 10 is locked when combination slide valve 26 is pushed into this opening 36, wherein rotary slide valve 14 together with slide-valve core 10 is still moved into the final casting position, as is represented in FIG. 3, i.e. out of the preliminary final casting position into the final casting position. And conversely, rotary slide valve 14 together with slide-valve core 10 is locked when combination slide valve 26 is pulled out of this opening 36, wherein slide-valve core 10 is released from the solidified die cast part and rotary slide valve 14 together with slide-valve core 10 is moved into a preliminary mould-removal position, as is represented in FIG. 2.

As can clearly be seen in the drawing, the part of combination slide valve 26 pushed into and pulled out of recess 32 of rotary slide valve 14 and recess 32 of rotary slide valve 14 comprise corresponding inclined planes 38.

LIST OF REFERENCE NUMBERS (is part of the description)

10 arc-shaped slide-valve core
12 rotary slide-valve arrangement
14 arc-shaped rotary slide valve
16 hydraulic cylinder
18 piston rod
20 end face

22 rotary slide-valve guide
24 outer radius
26 combination slide valve
28 hydraulic cylinder
30 piston rod
32 recess of rotary slide valve
34 recess of rotary slide-valve guide
36 opening
38 inclined plane
40 end face
42 end face
44 inner radius
46 edges running conically towards one another
48 contact faces running conically towards one another
50 distributor groove
52 feeding channel
54 lubricating grooves
56 recess

The invention claimed is:

1. An apparatus for producing a die cast part with an arc-shaped inside and/or outside casting contour, the apparatus comprising:

a permanent mold with at least one mobile arc-shaped slide-valve core, the permanent mold forming the arc-shaped inside and/or outside casting contour of the die cast part via die casting, a rotary slide-valve arrangement moving the at least one mobile arc-shaped slide-valve core before the die casting on an arc-shaped path into the permanent mold and after the die casting on an arc-shaped path out of the permanent mold; and a combination slide valve;

wherein the rotary slide-valve arrangement comprises an arc-shaped rotary slide-valve, wherein the combination slide valve locks the arc-shaped rotary slide valve together with the at least one mobile arc-shaped slide-valve core after the movement into the permanent mold and moves the arc-shaped rotary slide-valve together with the at least one mobile slide-valve core into a final casting position, and wherein the combination slide valve unlocks the arc-shaped rotary slide valve together with the at least one mobile arc-shaped slide-valve core before the movement out of the permanent mold, thereby releases the at least one mobile arc-shaped slide-valve core from the die cast part when the die cast part is solidified, and moves the arc-shaped rotary slide valve together with the at least one mobile slide-valve core into a preliminary mold-removal position.

2. The apparatus according to claim 1, wherein the rotary slide-valve arrangement is a mechanical, pneumatic or hydraulically operated core push-and-pull arrangement.

3. The apparatus according to claim 1, wherein the arc-shaped rotary slide valve is connected to the at least one mobile arc-shaped slide-valve core at an end face of the at least one mobile arc-shaped slide-valve core.

4. The apparatus according to claim 3, wherein the rotary slide-valve arrangement comprises at least one displacing device in an active connection with the arc-shaped rotary slide valve in such a way that the at least one displacing device imparts an arc-shaped displacement movement to the arc-shaped rotary slide valve and therefore to the at least one mobile arc-shaped slide-valve core

5. The apparatus according to claim 4, wherein the at least one displacing device comprises a hydraulic cylinder having a piston rod having an active connection with a first end face of the arc-shaped rotary slide valve, said first end face of the arc-shaped rotary slide valve not being directly connected to the at least one mobile arc-shaped slide-valve core, and wherein the active connection imparts the arc-shaped displacement movement to the arc-shaped rotary slide valve and therefore to the at least one mobile arc-shaped slide-valve core when a rectilinear displacement of the piston rod takes place.

6. The apparatus according to claim 1, wherein the rotary slide-valve arrangement comprises a rotary slide-valve guide and the arc-shaped rotary slide-valve has an end face not directly connected to the at least one mobile arc-shaped slide-valve core, such that when the arc-shaped rotary slide-valve is pushed or pulled at the end face, the arc-shaped rotary slide-valve is moved in an arc-shaped manner in the rotary slide-valve guide.

7. The apparatus according to claim 6, wherein the rotary slide-valve guide is an arc-shaped bush and the arc-shaped rotary slide valve can move in the arc-shaped bush, and wherein the arc-shaped bush has an inner cross-section matched to the arc-shaped rotary slide-valve.

8. The apparatus according to claim 5, wherein the hydraulic cylinder with the piston rod is disposed in such a way that:

when the arc-shaped rotary slide valve is displaced in a direction of the permanent mold, force is essentially exerted only on a first inner face of the arc-shaped rotary slide-valve guide, the first inner face forming an outer radius, and when the arc-shaped rotary slide valve is displaced in a direction of a mold-removal position, force is essentially exerted only on a second inner face of the arc-shaped rotary slide-valve guide, the second inner face forming an inner radius.

9. The apparatus according to claim 6, further comprising a lubricating device for introducing and/or distributing lubricant between the rotary slide-valve guide and the arc-shaped rotary slide valve during the die casting.

10. The apparatus according to claim 9, wherein the lubricating device comprises at least one distributor groove connected to at least one supply channel leading from an exterior into the rotary slide-valve guide.

11. The apparatus according to claim 9, wherein the lubricating device comprises lubricating grooves disposed on the arc-shaped rotary slide valve.

12. The apparatus according to claim 1, wherein the rotary slide-valve arrangement further comprises at least one lock locking the arc-shaped rotary slide-valve and therefore the at least one mobile arc-shaped slide-valve core after the movement into the permanent mold and unlocking the arc-shaped rotary slide-valve and therefore the at least one mobile arc-shaped slide-valve core before the movement out of the permanent mold.

13. The apparatus according to claim 1, wherein the combination slide valve can be operated mechanically, pneumatically or hydraulically.

14. The apparatus according to claim 1, wherein the rotary slide-valve arrangement further comprises a rotary slide valve guide, wherein the arc-shaped rotary slide-valve and the rotary slide-valve guide each comprise a recess such that, after the at least one mobile arc-shaped slide-valve core has been moved into the permanent mold, the recesses form a common opening for accommodating the combination slide valve, wherein the combination slide valve and the common opening are constituted in such a way that the arc-shaped rotary slide-valve is locked together with the at least one mobile arc-shaped slide-valve core when the combination slide valve is pushed into the common opening, wherein the arc-shaped rotary slide-valve is moved together with the at least one mobile slide-valve core into the final casting position, and the arc-shaped rotary slide valve is unlocked together with the at least one mobile slide-valve core when the combination slide valve is pulled out of the common opening, and wherein the at least one mobile slide-valve core is released from the die cast part when the die cast part is solidified and the arc-shaped rotary slide valve is moved together with the at least one mobile slide-valve core into the preliminary mold-removal position.

15. The apparatus according to claim 14, wherein a part of the combination slide valve is pushed into and pulled out of the recess of the arc-shaped rotary slide valve and comprises a first inclined plane and the recess of the arc-shaped rotary slide valve comprises a second inclined plane, such that when the part of the combination slide valve is pushed into the recess of the arc-shaped rotary slide-valve, the arc-shaped rotary slide-valve is displaced in a direction of the permanent mold and such that, when the part of the combination slide valve is pulled out of the recess of the arc-shaped rotary slide valve, the arc-shaped rotary slide valve is displaced in an opposite direction to the permanent mold.

16. The apparatus according to claim 14, wherein the combination slide valve and the common opening have a precise fit with respect to one another.

17. The apparatus according to claim 1, wherein a first end face of the at least one mobile arc-shaped slide-valve core is not directly connected to the arc-shaped rotary slide-valve and is connected in a casting position to a shape-forming part of the permanent mold in such a way that the connection is tight with respect to a casting material flowing under pressure.

18. The apparatus according to claim 1, wherein the apparatus can produce the die cast part from a casting material comprising a casting metal.

19. The apparatus according to claim 1, wherein the arc-shaped rotary slide-valve comprises an end face pointing towards the permanent mold, and edges running conically towards one another at the end face pointing towards the permanent mold, and wherein the permanent mold comprises a recess for the arc-shaped rotary slide valve, the recess comprising contact faces running towards one another, and wherein the edges of the arc-shaped rotary slide-valve correspond to the contact faces of the recess of the permanent mold.

20. The apparatus according to claim 1, further comprising a blowing device, wherein after unlocking of the arc-shaped rotary slide-valve together with the at least one mobile arc-shaped slide-valve core, the blowing device blows sealing air into a gap between the arc-shaped rotary slide-valve and the permanent mold in a direction of the at least one mobile arc-shaped slide-valve core.

21. The apparatus according to claim 1, wherein the arc-shaped rotary slide-valve and the at least one mobile arc-shaped slide-valve core are made from heat-resisting materials.

22. The apparatus according to claim 3, wherein the arc-shaped rotary slide valve is connected to the at least one mobile arc-shaped slide-valve core at the end face of the at least one mobile arc-shaped slide-valve core in a firmly bonded manner.

23. The apparatus according to claim 6, wherein the rotary slide-valve guide is stationary.

24. The apparatus according to claim 10, wherein the at least one distributor groove is drawn over a length of an outer radius of the rotary slide valve guide that lies on an inner face and is countersunk therein.

25. The apparatus according to claim 11, wherein the lubricating grooves run in a radiating manner towards an imaginary center-point of the arc-shaped rotary slide valve.

26. The apparatus according to claim 21, wherein the surface of the slide-valve core additionally is nitration-hardened.

27. A method for producing a die cast part, the method comprising steps of:

(a) providing an apparatus comprising:

a permanent mold with at least one mobile arc-shaped slide-valve core, and a rotary slide-valve arrangement able to move the at least one mobile arc-shaped slide-valve core on an arc-shaped path into the permanent mold and on an arc-shaped path out of the permanent mold, (b) moving from an initial position the at least one mobile arc-shaped slide-valve core in the arc-shaped path into the permanent mold via an arc-shaped rotary slide-valve of the rotary slide-valve arrangement, the arc-shaped rotary slide-valve being moved together with the at least one mobile arc-shaped slide-valve core before the die casting via a first actuation device into a preliminary final casting position (c) moving via a second actuation device the arc-shaped rotary slide-valve together with the at least one mobile arc-shaped slide-valve core into a final casting position such that the arc-shaped rotary slide-valve and the at least one mobile arc-shaped slide-valve core are locked before the die casting, (d) subsequently die casting a die cast part in the permanent mold, (e) after the die casting, moving via said second actuation device the arc-shaped rotary slide-valve together with the at least one mobile arc-shaped slide-valve core into a preliminary mold-removal position, (f) releasing the at least one mobile arc-shaped slide-valve core from the solidified die cast part, (g) unlocking the arc-shaped rotary slide-valve together with the at least one mobile arc-shaped slide-valve core, and (h) after the die casting, moving the at least one mobile arc-shaped valve core out of the permanent mold on the arc-shaped path, the arc-shaped rotary slide-valve together with the at least one mobile arc-shaped slide-valve core being moved via said first actuation device into a mold-removal position, the mold-removal position being the initial position wherein the arc-shaped path is essentially defined by a radius of the at least one mobile arc-shaped slide-valve core.

28. The method according to claim 27, wherein the die cast part is a housing of an internal combustion engine with curved intake manifolds integrally molded in one piece.

* * * * *